US006046148A

United States Patent [19]

Toussaint et al.

[11] Patent Number: 6,046,148

[45] Date of Patent: Apr. 4, 2000

[54] ACIDIC LIGHT DUTY LIQUID CLEANING COMPOSITIONS

[75] Inventors: Christine Toussaint, Oupeye; Jean Massaux, Olne; Isabelle Leonard, Voroux-Lez-Liers; Claude Blanvalet, Angleur, all of Belgium

[73] Assignee: Colgate-Palmolive Co., Piscataway, N.J.

[21] Appl. No.: 09/410,826

[22] Filed: Oct. 1, 1999

[51] Int. Cl.[7] ..... C11D 1/29; C11D 1/14; C11D 3/16

[52] U.S. Cl. ..... 510/235; 510/242; 510/251; 510/253; 510/352; 510/356; 510/365; 510/417; 510/421; 510/428; 510/432; 510/463; 510/477

[58] Field of Search ..... 510/235, 242, 510/251, 253, 352, 356, 365, 417, 421, 428, 432, 463, 477

[56] References Cited

U.S. PATENT DOCUMENTS

| | | | |
|---|---|---|---|
| 5,076,954 | 12/1991 | Loth et al. | 252/122 |
| 5,192,460 | 3/1993 | Thomas et al. | 252/142 |
| 5,500,151 | 3/1996 | Cao et al. | 252/546 |

*Primary Examiner*—Mark Kopez
*Assistant Examiner*—Charles Boyer
*Attorney, Agent, or Firm*—Richard E. Nanfeldt

[57] ABSTRACT

A light duty liquid detergent with desirable cleansing properties to the human skin comprising a $C_{8-18}$ ethoxylated alkyl ether sulfate anionic surfactant, a sulfonate anionic surfactant, an organic acid and water.

10 Claims, No Drawings

ACIDIC LIGHT DUTY LIQUID CLEANING COMPOSITIONS

FIELD OF INVENTION

This invention relates to an acidic light duty liquid cleaning composition which imparts mildness to the skin which can be in the form of a microemulsion designed in particular for cleaning hard surfaces and which is effective in removing particular and grease soil in leaving unrinsed surfaces with a shiny appearance.

BACKGROUND OF THE INVENTION

In recent years all-purpose light duty liquid detergents have become widely accepted for cleaning hard surfaces, e.g., dishes, glasses, sinks, painted woodwork and panels, tiled walls, wash bowls, washable wall paper, etc. Such all-purpose liquids comprise clear and opaque aqueous mixtures of water-soluble organic detergents and water-soluble detergent builder salts.

The present invention relates to light duty liquid detergent compositions with high foaming properties, which contain a sulfonate surfactant and a hydroxy aliphatic acid.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

SUMMARY OF THE INVENTION

It has now been found that an acid light duty liquid detergent can be formulated with an anionic surfactant which has desirable cleaning properties and mildness to the human skin.

An object of this invention is to provide an acidic light duty liquid detergent composition which can be in the form of a microemulsion, and comprises a sulfate and/or sulfonate anionic surfactant and an organic acid, wherein the composition does not contain any N-alkyl aldonamide zwitterionic surfactant, silicas, abrasives, alkali metal carbonates, alkaline earth metal carbonates, alkyl glycine surfactant or a cyclic imidinium surfactant.

Another object of this invention is to provide an acidic light duty liquid detergent with desirable high foaming and cleaning properties which kills bacteria.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

The microemulsion light duty liquid compositions of the instant invention comprises approximately by weight:

(a) 8% to 30% of an alkali metal salt of an anionic sulfonate surfactant;

(b) 2% to 15% of an alkali metal salt of a $C_{8-18}$ ethoxylated alkyl ether sulfate and/or an C8–18 alkyl ether sulfate;

(c) 0% to 10% of an ethoxylated nonionic surfactant;

(d) 0 to 5% of polyethylene glycol;

(e) 0.1% to 5% of an organic acid;

(f) 0 to 10% of at least one solubilizing agent;

(g) 0.5% to 14% of at least one cosurfactant;

(h) 0 to 5% of an inorganic magnesium salt;

(i) 0.5% to 8% of a water insoluble organic ester or a water insoluble material such as terpene or essential oils;

(j) 0 to 2%, more preferably 0.05% to 2% of a thickener; and (k) the balance being water.

The nonmicroemulsion light duty liquid compositions of the instant invention comprise approximately by weight:

(a) 8% to 30% of an alkali metal salt of an anionic sulfonate surfactant;

(b) 2% to 15% of an alkali metal salt of an C8–18 ethoxylated alkyl ether sulfate and/or a C8–18 alkyl ether sulfate;

(c) 0% to 10% of an ethoxylated nonionics surfactant;

(d) 0% to 8% of a water insoluble organic ester or a water insoluble material such as terpene or essential oils;

(e) 0 to 5% of a polyethylene glycol;

(f) 0 to 5% of an inorganic magnesium salt;

(g) 0 to 10% of a solubilizer;

(h) 0.1% to 5% of an organic acid;

(i) 0 to 2%, more preferably 0.05% to 2% of a thickener; and (j) the balance being water.

The instant compositions do not contain an N-alkyl aldonamide, choline chloride or buffering system which is a nitrogenous buffer which is ammonium or alkaline earth carbonate, guanidine derivates, alkoxylalkyl amines and alkyleneamines, which do not contain a hydroxy group, phosphoric acid, amino alkylene phosphonic acid and the composition is pourable and is not a gel and the composition has a complex viscosity at 1 rads-1 of less than 0.4 Pascal seconds.

The anionic sulfonate surfactants which may be used in the detergent of this invention are water soluble and include the sodium, potassium, ammonium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates and mixtures thereof. The preferred anionic sulfonate surfactant is a $C_{12-18}$ paraffin sulfonate.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The $C_{8-18}$ ethoxylated alkyl ether sulfate surfactants have the structure $$R—(OCHCH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 2 to about 15 wt. %.

The compositions of the present invention may contain a nonionic surfactant or mixtures thereof. Suitable nonionic surfactants for use herein are fatty alcohol ethoxylates which are commercially available with a variety of fatty alcohol chain lengths and a variety of ethoxylation degrees. Indeed, the HLB values of such nonionic surfactants depend essentially on the chain length of the fatty alcohol and the degree of ethoxylation. Particularly suitable nonionic surfactants are the condensation products of a higher aliphatic alcohol containing about 8 to 18 carbon atoms in a straight or branched chain configuration, condensed with about 2 to 30 moles of ethylene oxide.

The organic acid is used in the nonmicroemulsion or microemulsion composition at a concentration of about 0.1 wt. % to about 5 wt. %, more preferably about 0.5 wt. % to about 4 wt. %. The organic acid used in the instant composition is selected from the group consisting of malonic acid, fumaric acid, glutaric acid, succinic acid, benzoic acid and ascorbic acid and mixtures thereof.

The thickener is used at a concentration of 0 to about 2 wt. %, more preferably about 0.05 wt. % to about 2 wt. %. A preferred polymeric thickener is a sodium salt of a polyacrylic acid having a molecular weight of 500000 such as Acusol 820 sold by ROHM & HAAS. Other thickeners which could be used are cellulose, hydroxypropyl cellulose, polyacrylate polyacrylamides and polivilyl alcohol.

The water insoluble saturated organic diester has the formula:

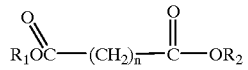

wherein $R_1$ and $R_2$ are independently a $C_2$ to $C_6$ alkyl group and n is a number from 4 to 8. A preferred organic diester is dibutyl adipate. The concentration of the organic diester in the microemulsion composition is about 0.5 wt. % to about 8 wt. %, more preferably about 1 wt. % to about 6 wt. %.

Among components of different types of perfumes that may be employed are the following: essential oils—pine, balsam, fir, citrus, evergreen, jasmine, lily, rose and ylang ylang; esters—phenoxyethyl isobutyrate, benzyl acetate, p-tertiary butyl cyclohexyl acetate, guaiacwood acetate, linalyl acetate, dimethylbenzyl carbinyl acetate, phenylethyl acetate, linalyl benzoate, benzyl formate, ethylmethylphenyl glycidate, allylcyclohexane propionate, styrallyl propionate and benzyl salicylate; ethers—benzyl-ethyl ether; aldehydes—alkyl aldehydes of 8 to 18 carbon atoms, bourgeonal, citral, citronellal, citronellyl oxyacetaldehyde, cyclamen aldehyde, hydroxycitronellal and lilial; alcohols—anethol, citronellol, eugenol, geraniol, linalool, phenylethyl alcohol and terpineol; hydrocarbons—balsams and terpenes; ketones—ionones, alpha-isomethyl ionone, and methylcedryl ketone; lactones—gamma-alkyl lactone wherein the alkyl is of 8 to 14 carbon atoms; pyrrones—hydroxy-lower alkyl pyrrone wherein the alkyl is of 1 to 4 carbon toms; and pyrroles—benzopyrrole.

While various components of perfumes that are considered to be useful in the invented composition have been described above, the particular composition of the perfume is not considered to be critical with respect to cleaning properties so long as it is water insoluble (and has an acceptable fragrance). For use by the housewife or other consumer in the home, the perfume, as well as all other components of these cleaners, should be cosmetically acceptable, i.e., non-toxic, hypoallergenic, etc.

The polyethylene glycol used in the instant composition has a molecular weight of 200 to 1,000, wherein the polyethylene glycol has the structure $HO(CH_2CH_2O)_nH$ wherein n is 4 to 25. The concentration of the polyethylene glycol in the instant composition is 0 to 5 wt. %, more preferably 0.1 wt. % to 4 wt. %.

The instant light duty liquid nonmicroemulsion compositions contain about 0 wt. % to about 10 wt. %, more preferably about 1 wt. % to about 8 wt. %, of at least one solubilizing agent selected from the group consisting of a $C_{2-5}$ mono, dihydroxy or polyhydroxy alkanols such as ethanol, isopropanol, glycerol ethylene glycol, diethylene glycol and propylene glycol and mixtures thereof and alkali metal cumene or xylene sulfonates such as sodium cumene sulfonate and sodium xylene sulfonate. The solubilizing agents are included in order to control low temperature cloud clear properties.

The cosurfactant used in the microemulsion composition may play an essential role in the formation of the microemulsion compositions. Very briefly, in the absence of the cosurfactant the water, detergent(s) and hydrocarbon (e.g., perfume) will, when mixed in appropriate proportions form either a micellar solution (low concentration) or form an oil-in-water emulsion in the first aspect of the invention. With the cosurfactant added to this system, the interfacial tension at the interface between the emulsion droplets and aqueous phase is reduced to a very low value. This reduction of the interfacial tension results in spontaneous break-up of the emulsion droplets to consecutively smaller aggregates until the state of a transparent colloidal sized emulsion. e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized.

Thus, the role of cosurfactant in formation of a stable o/w microemulsion is to (a) decrease interfacial tension (2); and (b) modify the microemulsion structure and increase the number of possible configurations (3). Also, the cosurfactant will (c) decrease the rigidity. Generally, an increase in cosurfactant concentration results in a wider temperature range of the stability of the product.

The major class of compounds found to provide highly suitable cosurfactants for the microemulsion over temperature ranges extending from 5° C. to 43° C. for instance are polypropylene glycol of the formula $HO(CH_3CHCH_2O)_nH$ wherein n is a number from 1 to 18, and mono and di $C_1$–$C_6$ alkyl ethers and esters of ethylene glycol and propylene glycol having the structural formulas $R(X)_nOH$, $R_1(X)_nOH$, $R(X)_nOR$ and $R_1(X)_nOR_1$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1 methoxy-2-propanol, 1 methoxy-3-propanol, and 1 methoxy 2-, 3- or 4-butanol.

Representative members of the polypropylene glycol include dipropylene glycol and polypropylene glycol having a molecular weight of 150 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate. When these glycol type cosurfactants are at a concentration of about 0.5 to about 14 weight %, more preferably about 2.0 weight % to about 10 weight % in combination with a water insoluble organic ester or non water soluble material such as terpene, essential oils which is at a concentration of at least 0.5 weight %, more preferably 1.5 weight % to about 8 wt. % one can form a microemulsion composition.

While all of the aforementioned glycol ether compounds provide the described stability, the most preferred cosurfactant compounds of each type, on the basis of cost and cosmetic appearance (particularly odor), are dipropylene glycol monomethyl ether and propylene glycol. Other suitable water soluble cosurfactants are water soluble esters such as ethyl lactate and water soluble carbohydrates such as butyl glycosides.

The instant microemulsion formulas explicitly exclude alkali metal silicates and alkali metal builders such as alkali metal polyphosphates, alkali metal carbonates and alkali metal phosphonates because these materials, if used in the instant composition, would cause the composition to have a high pH as well as leaving residue on the surface being cleaned.

The final essential ingredient in the inventive microemulsion or nonmicroemulsion compositions having improved interfacial tension properties is water. The proportion of water in the compositions generally is in the range of 35% to 90%, preferably 50% to 85% by weight of the usual diluted o/w microemulsion composition.

In addition to the above-described essential ingredients required for the formation of the microemulsion composition, the compositions of this invention may often and preferably do contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

Thus, depending on such factors as the pH of the system, the nature of the primary surfactants and cosurfactant, and so on, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of paraffin sulfonate, alkylbenzene sulfonate, etc., while for each gram-ion of $A1^{3+}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic surfactant. At higher concentrations of anionic surfactant, the amount of the inorganic magnesium salt will be in range of 0 to 5 wt. %, more preferably 0.5 to 3 wt. %.

The liquid cleaning composition of this invention may, if desired, also contain other components either to provide additional effect or to make the product more attractive to the consumer. The following are mentioned by way of example: Colors or dyes in amounts up to 0.5% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the instant compositions exhibit stability at reduced and increased temperatures. More specifically, such compositions remain clear and stable in the range of 5° C. to 50° C., especially 10° C. to 43° C. Such compositions exhibit a pH of 3 to 7.0. The liquid microemulsion compositions are readily pourable and exhibit a viscosity in the range of 6 to 400 milliPascal.second (mPas.) as measured at 25° C. with a Brookfield RVT Viscometer using a #2 spindle rotating at 50 RPM.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure:

| | A | B | C | D | E | F |
|---|---|---|---|---|---|---|
| $C_{14-16}$ paraffin sulfonates sodium salt | 21.33 | 21.33 | 21.33 | 21.33 | 21.33 | 21.33 |
| $C_{13-14}$ AEOS 2:1 EO | 10.67 | 10.67 | 10.67 | 10.67 | 10.67 | 10.67 |
| Polyethylene glycol MN300 | 1.5 | 1.5 | 1.5 | 1.5 | 1.5 | 1.5 |
| MgSO47H2O | 2 | 2 | 2 | 2 | 2 | 2 |
| Dipropylene glycol monobutyl ether | 1 | 1 | 1 | 1 | 1 | 1 |
| Malonic acid | 2 | | | | | |
| Fumaric acid | | 0.4 | | | | |
| Glutaric acid | | | 2 | | | |
| Succinic acid | | | | 2 | | |
| Benzoic acid | | | | | 0.34 | |
| Ascorbic acid | | | | | | 2 |
| Perfume | 0.4 | 0.4 | 0.4 | 0.4 | 0.4 | 0.4 |
| Water | Bal. | Bal. | Bal. | Bal. | Bal. | Bal. |
| Appearance @ RT | Clear | Clear | Clear | Clear | Clear | Clear |
| Appearance @ 4° C. | Clear | Clear | Clear | Clear | Cloudy | Clear |
| pH | 2.6 | 3.5 | 4 | 3.6 | 5.6 | 3.95 |
| Viscosity (RVT, 50 rmp, spd2) | 376 | 432 | 320 | 360 | 216 | 464 |

What is claimed:

1. A clear microemulsion light duty liquid cleaning composition which comprises approximately by weight:

(a) 8% to 30% of an alkali metal salt of a sulfonated anionic surfactant;

(b) 2% to 15% of an alkali metal salt of a $C_{8-18}$ ethoxylated alkyl ether sulfate and/or a C8–18 alkyl ether sulfate;

(c) 0% to 10% of an ethoxylated nonionic surfactant;

(d) 0.01% to 5% of a polyethylene glycol;

(e) 0.1% to 5% of an organic acid selected from the group consisting of benzoic acid, malonic acid, fumaric acid, succinic acid, glutaric acid and ascorbic acid and mixtures thereof;

(f) 0 to 10% of at least one solubilizing agent;

(g) 0.5% to 14% of a cosurfactant;

(h) 0.05% to 5% of an inorganic magnesium salt;

(i) 0.5% to 8% of water insoluble organic ester or a water insoluble material selected from the group consisting of terpenes and essential oils;

(j) 0 to 2% of a thickener and (k) the balance being water.

2. The composition of claim 1, wherein said solubilizing agent is selected from the group consisting of sodium, potassium, ammonium salts of cumene, xylene, toluene sulfonates and mixtures thereof.

3. The composition of claim 1, wherein said solubilizing agent is sodium cumene sulfonate.

4. The composition of claim 1, wherein said solubilizing agent is selected from the group consisting of isopropanol, ethanol glycerol, ethylene glycol, diethylene glycol and propylene glycol and mixtures thereof.

5. The composition of claim 1, wherein said cosurfactant is selected from the group consisting of polyethylene glycols having a molecular weight of 150 to 1000, polypropylene glycol of the formula $HO((CH_3)CHCH_2O)_nH$, wherein n is 1 to 18, polyethylene and propylene glycol ethers and esters having the formula of R(X)nOH, R1(X)nOH, R(X)nOR, R(X)nOR1, R1(X)nOR and R1(X)nOR1 wherein R is a C1–6 alkyl group, R1 is a C1–6 acyl group, X is (OCH2CH2) or (OCH2CHCH3) and n is from 1 to 8 and mixtures thereof.

6. The composition of claim 1, wherein said cosurfactant is dipropylene glycol monomethyl ether.

7. A clear nonmicroemulsion light duty liquid cleaning composition which comprises approximately by weight:

(a) 8% to 30% of an alkali metal salt of a sulfonated anionic surfactant;

(b) 2% to 15% of an alkali metal salt of an C8–18 ethoxylated alkyl ether sulfate and/or a C8–18 alkyl ether sulfate;

(c) 0% to 10% of an ethoxylated nonionic surfactant;

(d) 0 to 8% of a water insoluble organic ester or a water insoluble material selected from the group consisting of terpenes and essential oils;

(e) 0.01% to 5% of a polyethylene glycol;

(f) 0.1% to 5% of an organic acid selected from the group consisting of benzoic acid, malonic acid, fumaric acid, succinic acid, glutaric acid and ascorbic acid and mixtures thereof;

(g) 0 to 10% of a solubilizer;

(h) 0.05% to 5% of an inorganic magnesium salt;

(i) 0 to 2% of a thickener; and (j) the balance being water.

8. The composition of claim 7, wherein said solubilizing agent is selected from the group consisting of sodium, potassium, ammonium salts of cumene, xylene, toluene sulfonate and mixtures thereof.

9. The composition of claim 7, wherein said solubilizing agent is sodium cumene sulfonate.

10. The composition of claim 7, wherein said solubilizing agent is selected from the group consisting of isopropanol, ethanol, glycerol, ethylene glycol, diethylene glycol and propylene glycol and mixtures thereof.

* * * * *